US006547630B2

(12) United States Patent
Beaman

(10) Patent No.: US 6,547,630 B2
(45) Date of Patent: Apr. 15, 2003

(54) HEART SHAPED NOVELTY DEVICE

(76) Inventor: Richard Beaman, 30-11 Murray St., Flushing, NY (US) 11354

( * ) Notice: Subject to any disclaimer, the term of this patent is extended or adjusted under 35 U.S.C. 154(b) by 0 days.

(21) Appl. No.: 09/892,814

(22) Filed: Jun. 27, 2001

(65) Prior Publication Data

US 2003/0003841 A1 Jan. 2, 2003

(51) Int. Cl.[7] ..... A63H 5/00
(52) U.S. Cl. ..... 446/297; 446/404; 446/484
(58) Field of Search ..... 446/397, 404, 446/408, 484, 236, 242, 297

(56) References Cited

U.S. PATENT DOCUMENTS 4,124,022 A 11/1978 Gross
4,508,520 A 4/1985 Sellers et al.
4,718,876 A 1/1988 Lee
4,737,131 A 4/1988 Sirota
4,836,823 A 6/1989 Laven
5,063,912 A * 11/1991 Hughes ..... 446/295
5,228,879 A * 7/1993 Fromm ..... 362/140
5,725,409 A * 3/1998 Brunton ..... 273/293
5,816,885 A 10/1998 Goldman et al.
6,116,983 A * 9/2000 Long et al. ..... 446/227

* cited by examiner

*Primary Examiner*—Jacob K. Ackun
(74) *Attorney, Agent, or Firm*—Collard & Roe, P.C.

(57) ABSTRACT

The invention relates to a heart shaped novelty device. This heart shaped novelty device contains a microprocessor, a memory, a timer, at least one switch, a noise maker and an oscilloscope display. The timer is set on a random time, wherein when the timer runs down, the microprocessor signals the noise maker to make a noise while the oscilloscope display changes its display from a heart beat display to a pure flat line. At this point a user can pick the heart shaped novelty device up and squeeze its sides to trigger the switch. Once the switch has been triggered, the noise maker will stop making noise and the oscilloscope display will change back to a heart beat display. In another embodiment of the invention, the heart shaped novelty device also contains an electronic drum beat that beats back and forth to simulate a heart beating.

16 Claims, 3 Drawing Sheets

HEART SHAPED NOVELTY DEVICE

BACKGROUND OF THE INVENTION

1. Field of the Invention

The invention relates to an electronic toy that signals an alarm when the toy has not been held for a period of time. More particularly, the invention relates to a heart-shaped toy that emits a sound, light and a beating sensation.

2. The Prior Art

Heart shaped novelty toys are known in the art. For example, U.S. Pat. No. 4,124,022 to Gross discloses a heart novelty and relaxation device. There is a heart-shaped housing that contains a speaker and circuitry for producing a slow heart beat sound which has a relaxing effect on a listener. In this case, the housing is assembled from two molded plastic conformal sides having integral complementary brackets that mate to hold the sides together along a median plane. There is a circuitry mounted on a board which also supports an on/off switch having a flat arm that pivots in the median plane. This flat arm projects unobtrusively from the housing through the slide of the interface between the sides to facilitate extra control of the device.

U.S. Pat. No. 4,737,131 to Sirota discloses a toy heart that is an expanding and contracting heart produced by a separate generator or in response to sensing a pulse beat of a child by a sensor.

U.S. Pat. No. 4,836,823 to Laven discloses a heart-shaped novelty item. In this case, there is a novelty item having a heart-shaped housing with a translucent window formed therein. The housing has two conductors formed on the exterior thereof. When the housing is held in a person's hand, there is a conductive path formed between the two conductors and one or more LED's in the interior of the housing begins to flash on and off to show the beating heart. In this case, there are shown side sensors or a back sensor wherein when the heart is held in the person's hand, it shows that the heart starts beating again.

U.S. Pat. No. 5,816,885 to Goldman et al discloses a deformable sound-generating electronic toy. In this case, the deformable toy can play back prerecorded or newly recorded sounds, music, messages which have predetermined playback rate as recorded to the device. There is disposed within the toy a piezoelectric transducer and a plunger engaging the body and the transducer responds to pressure transmitted through the medium by deforming of the body to shift the plunger.

U.S. Pat. No. 4,718,876 to Lee discloses a child calming toy with rhythmic stimulation. In this case, there is disclosed a stuffed animal having a pocket which contains a heart beat stimulating transducer. The power of the simulator heart beats may be regulated by an adjustment of a potentiometer via a knob. As shown there is a support pin which overlies a switch which is wired to actuate an electronic pulsing circuit powered by a battery.

U.S. Pat. No. 4,508,520 to Sellers et al discloses a light-emitting novelty device having a heart-shaped convex-concave, light-transmitting cover. Disposed within the heart is a miniature light bulb which is screwed into a socket of a light holder. There is also a switch which is connected to the circuit board to turn on the light.

The present invention differs from the prior art because the present invention contains a display showing an oscillating heart beat, a series of levers that can be used as sensors to revive a heart, and a timer to cause the heart to stop beating.

SUMMARY OF THE INVENTION

One object of the invention is to provide a simplfied novelty device that is easy to manufacture, and simple in design.

Another object of the invention is to provide a heart shaped novelty device that contains a display to imitate an oscillating heart beat.

Another object of the invention is to provide a heart shaped novelty device that contains a timer designed to randomly make the heart stop beating after a period of time.

Another object of the invention is to provide a heart shaped novelty device that contains a series of side levers designed to revive the heart beat after the heart has stopped beating.

These and other objects are achieved by providing an electronic toy that is designed to sound an alarm when that toy has not been held for a period of time. This toy is essentially designed as a heart-shaped toy having eyes, a nose and a mouth. In addition, attached to this toy is a chain for carrying this toy around.

This toy is of suitable size so that it can contain a series of electronic components. These electronic components include a battery such as a watch battery that powers a series of electronic components such as a timer, a memory/processor unit, a speaker and a visible oscilloscope display. In addition, connected with these electronic components is a series of switches that when closed, resets the timer within the electric circuit.

In addition, there is also an optional electromechanical drum that beats creating a beating sensation when a person holds onto the pet heart.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENT

Figure 1:
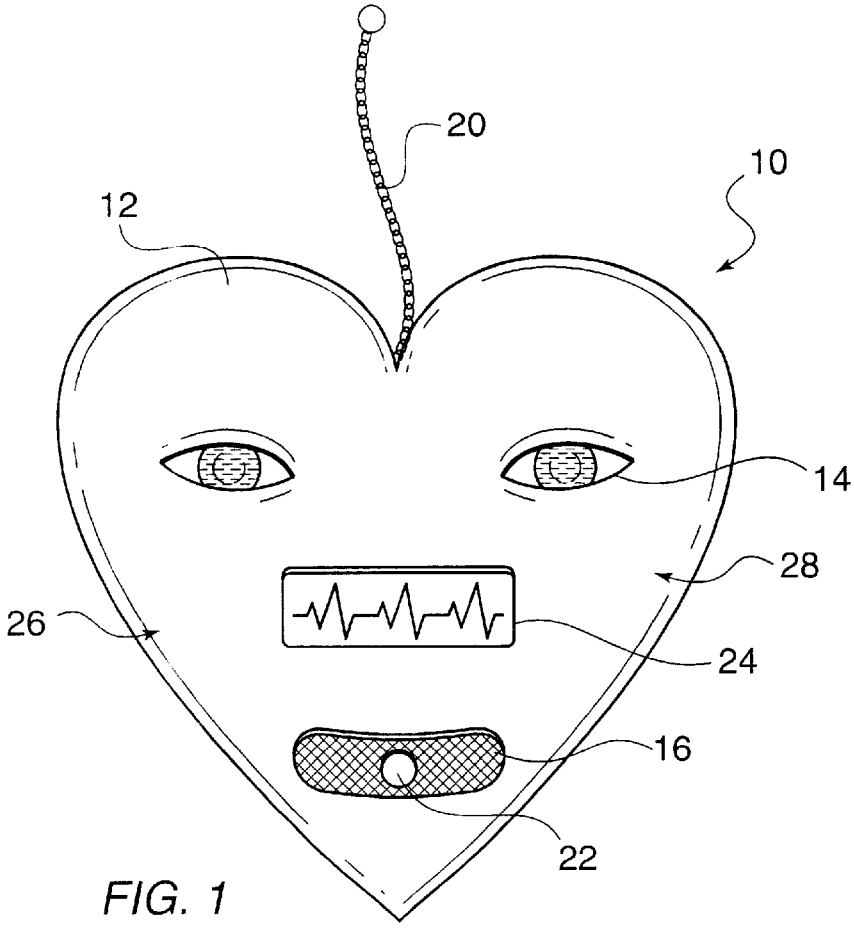
FIG. 1 is a front view of the heart-shaped toy.

FIG. 1 refers to a front view of the heart shaped novelty device 10. Here there is shown a cover 12 which is made from a cloth material. Disposed on cover 12 are two eyes 14 which are designed to give novelty device 10 a more life-like view.

In addition, disposed on cover 12 is a mouth 16. With this design, the heart shaped novelty device takes on the features of a human face so that children or other users can identify with heart shaped novelty device 10.

Furthermore, there is also disposed on device 10 a chain 20 that is designed to connect to a top region of device 10 to allow a user to carry device 10 on chain 20. In addition device 10 also contains an oscilloscope display 24, a speaker 22 disposed inside of mouth 16, and at least one lever connected to a switch located in regions 26 and 28 on device 10.

Figure 2:
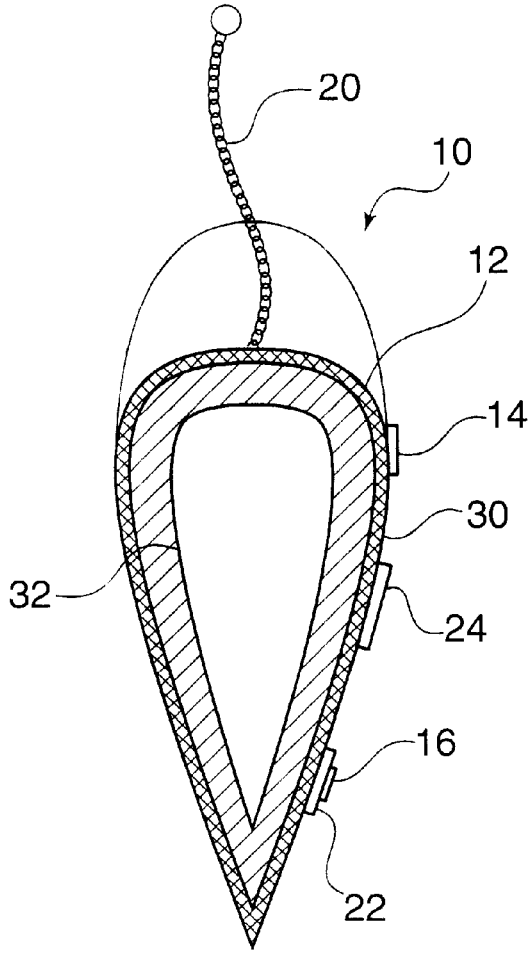
FIG. 2 is a cross sectional side view of the device.

As shown in FIG. 2, there is shown a cross section of device 10 wherein there is shown cover 12 which covers padding 30 and flexible housing 32. Padding 30 combines with cover 12 to give a user a soft feel for novelty device 10. In addition, housing 32 is made from a semi-rigid but flexible material. In a preferred embodiment this material is made from a flexible plastic such as poly ethylene or polypropylene.

Figure 3:
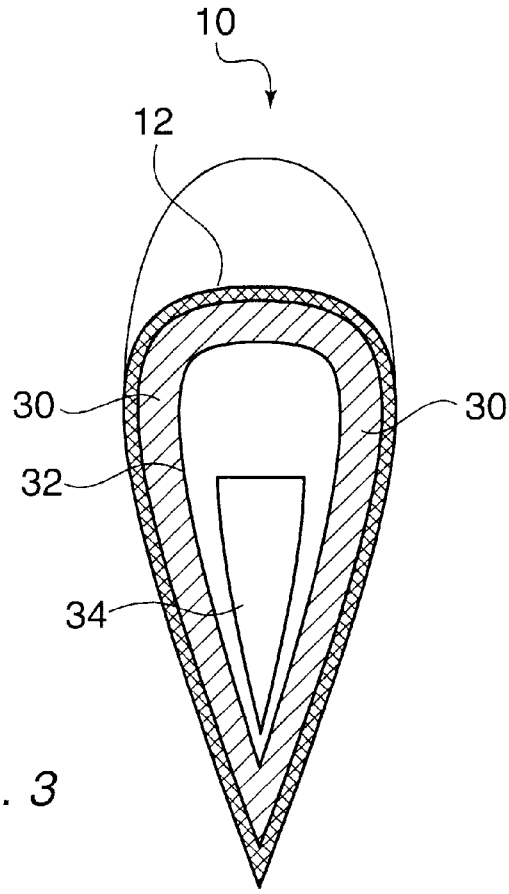
FIG. 3 is a cross sectional side view of the covering for the heart-shaped toy showing the clips.

FIG. 3 shows a side view of device 10 wherein there is shown a view of region 26 of housing 32 which contains a side lever 34. Side lever 34 is disposed within housing 32 and remains beneath padding 30 and cover 12. With this design, when a user presses on cover 12 in region 26, lever 34 presses in and activates switch 50 shown in FIG. 4. There is also an optional port (see FIG. 4) that opens out on cover 12 wherein this optional port allows device 10 to connect to an adjacent personal computer.

Figure 4:
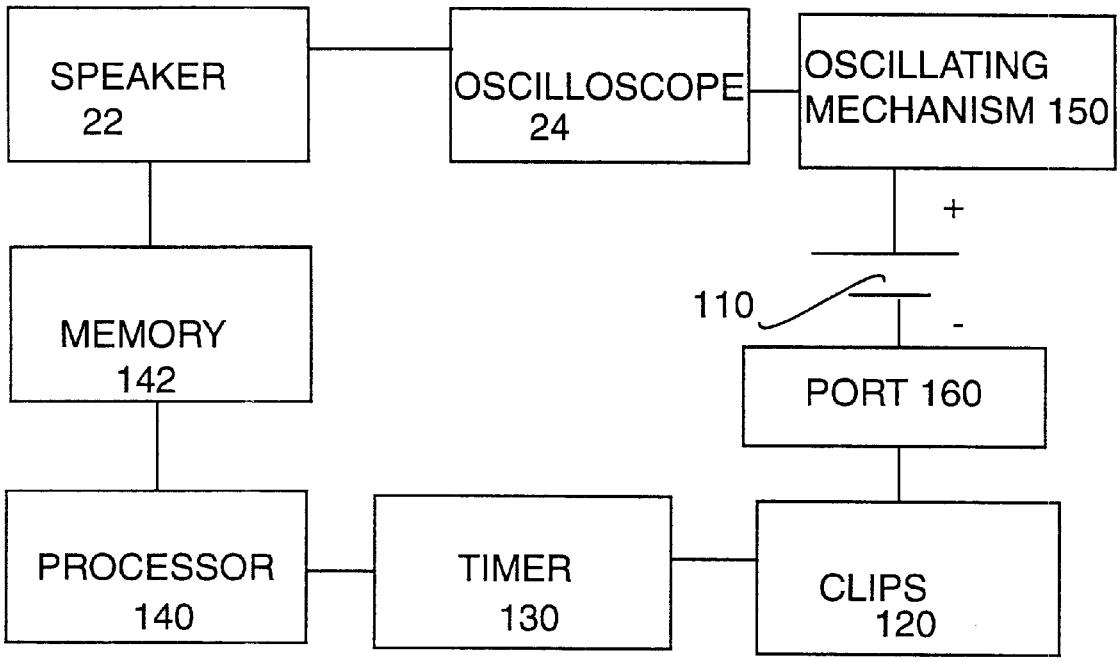
FIG. 4 is an electronic block diagram of the heart-shaped toy.

FIG. 4 shows a schematic block diagram 100 of device 10. This block diagram shows speaker 22, oscilloscope display 24, a power supply such as a battery 110, a series of clips 120, a timer 130 and a processor/memory unit 140 an oscillating mechanism 150 and an optional port 160 all electronically coupled together. Battery 110 provides power for the remaining components so that a user can read a heart beat on oscilloscope display 24, and can hear the beating of the heart, a flat line sound or a series of statements out of speaker 22. In addition, to simulate a heart beat, oscillating mechanism 150 is disposed inside of cover 12 wherein oscillating mechanism 150 is designed to create an oscillating beat or physical beat to simulate a heart beat. Timer 130 works along with processor 140 so that this device periodically fails to continue beating wherein each time the timer stops the heart from beating, processor 140 sends a signal to speaker 22, to sound an alarm from the heart.

Once the alarm has sounded, the user has a preset period of time such as one minute to revive the device before timer 130 shuts device 10 down. At this same time, oscillating mechanism 150 is designed to stop moving. If the user reaches device 10 before it has shut down, the user can then press on clips 120 to reset timer 130 and keep device 10 turned on. Processor 140 can also contain an additional memory 142 which can be used to allow device 10 to be programmed. Device 10 can be programmed so that it expires either randomly or after a preset period of time. In addition device 10 can be programmed so that it requires a certain number of hits or contacts on clips 120 to revive device 10.

Another way to revive the device would be to connect ports 160 to an external PC such as a particular heart reviving device. This PC or heart reviving device would revive the device until the next time timer 130 stops the device.

Figure 5:
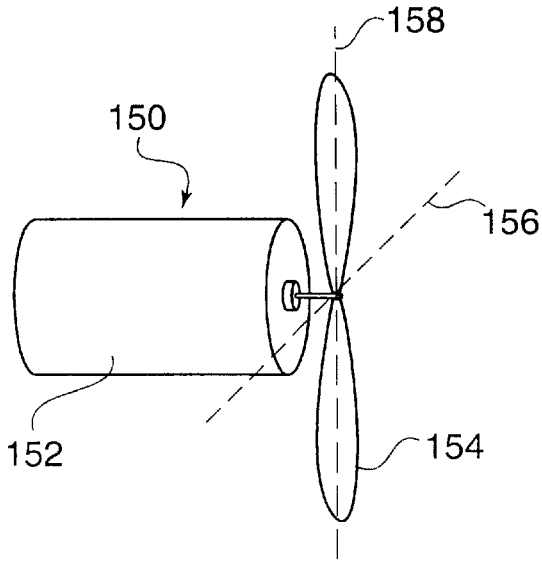
FIG. 5 is a perspective view of an oscillating device for simulating a heart beat.

FIG. 5, shows a vibrating or oscillating mechanism 150 can also be included. This oscillating mechanism 150 is designed to beat along with oscilloscope display 24 to simulate a heart beating. Oscillating mechanism 150 can be in the form of a rotating electrical motor 152 that turns a lever or propeller 154. During one portion of the rotation, lever 154 rotates into a region near axis 156 and may press out against cover 12, while during a second portion of the rotation, lever 154 rotates in a region near axis 158 device 10 so that lever 154 is extended lengthwise along device 10 so as to no longer press out against cover 12. This alternating pressing out and rotating inward of lever 154 thus simulates a heart beating.

Accordingly, while one embodiment of the present invention have been shown and described, it is to be understood that many changes and modifications may be made thereunto without departing from the spirit and scope of the invention as defined in the appended claims.

What is claimed is:

1. A novelty device comprising:

a) a housing having an outside region and an inside region;

b) a cover attached to said outside region of said housing;

c) an energy source disposed within said housing;

d) a noise maker disposed within said housing and connected to said energy source;

e) a timer connected to said noise maker and said energy source wherein said timer is designed to signal said noise maker to make a noise after a period of time; and f) at least one switch connected to said noise maker and to said timer wherein said switch can be accessed by a user in an outside region of said housing; and g) an oscilloscope display housed in said housing end connected to said microprocessor, wherein said oscilloscope display is shown through said cover, and said oscilloscope display shows a heart beat in said novelty device.

2. The novelty device as in claim 1, wherein said housing is made out of a semi-rigid plastic that is designed to bend when pressed upon by a user.

3. The novelty device as in claim 1, wherein said housing is heart-shaped.

4. The novelty device as in claim 1, wherein said cover comprises an inner pillow section disposed adjacent to said housing and an outer fabric section covering said pillow section.

5. The novelty device as in claim 4, wherein said outer fabric section is made from satin.

6. The novelty device as in claim 1, wherein said energy source is a DC energy source.

7. The novelty device as in claim 6, wherein said energy source is a battery.

8. The novelty device as in claim 1, wherein said energy source is an AC energy source.

9. The novelty device as in claim 1, wherein said noise maker is a speaker.

10. The novelty device as in claim 1, further comprising a microprocessor and a memory unit wherein said microprocessor is connected to said memory unit and said noise maker wherein said microprocessor is designed to receive instructions from said memory unit and control whether said noise maker makes noise.

11. The novelty device as in claim 1, wherein said at least one switch is designed to allow a user to switch off said noise maker once said noise maker is making a noise.

12. The novelty device as in claim 1, wherein said at least one switch is designed to reset a preset period of time on said timer.

13. The novelty device as in claim 1, further comprising a set of eyes disposed on said cover.

14. The novelty device as in claim 1, wherein said oscilloscope display receives instructions from said microprocessor so that said oscilloscope display periodically displays either a heart beat or a flat line meaning no heart beat.

15. The novelty device as in claim 1, further comprising an oscillating mechanism for simulating a physical heart beat.

16. The novelty device as in claim 1, further comprising a port for connecting said novelty device to an adjacent computer.

* * * * *